US006652803B2

(12) United States Patent
Watanabe et al.

(10) Patent No.: US 6,652,803 B2
(45) Date of Patent: Nov. 25, 2003

(54) PROCESS AND AN APPARATUS FOR NITRIDING AN ALUMINUM-CONTAINING SUBSTRATE

(75) Inventors: Morimichi Watanabe, Kasugai (JP); Shinji Kawasaki, Nagoya (JP); Takahiro Ishikawa, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/916,103

(22) Filed: Jul. 26, 2001

(65) Prior Publication Data

US 2002/0043300 A1 Apr. 18, 2002

(30) Foreign Application Priority Data

Jul. 31, 2000 (JP) ..... 2000-230468

(51) Int. Cl.[7] ..... C23C 8/24; C21D 1/773
(52) U.S. Cl. ..... 266/252; 422/239
(58) Field of Search ..... 266/252; 422/238, 422/239

(56) References Cited

U.S. PATENT DOCUMENTS

| | | | | |
|---|---|---|---|---|
| 3,238,018 A | | 3/1966 | Winter et al. | |
| 3,775,096 A | * | 11/1973 | Guidotti et al. | 75/622 |
| 4,768,757 A | | 9/1988 | Nakamura et al. | |
| 5,865,908 A | | 2/1999 | Takei et al. | |
| 6,074,494 A | * | 6/2000 | Miura et al. | 148/238 |
| 6,251,337 B1 | * | 6/2001 | Kane | 266/144 |

FOREIGN PATENT DOCUMENTS

| | | | | |
|---|---|---|---|---|
| EP | 0 795 621 A1 | | 9/1997 | |
| EP | 1 026 280 A2 | | 8/2000 | |
| JP | 08-269682 A | * | 10/1996 | C23C/8/24 |
| JP | WO 97/13002 A1 | * | 4/1997 | C23C/8/24 |

OTHER PUBLICATIONS

*Patent Abstracts of Japan*, vol. 1996, No. 7, Jul. 31, 1996 (JP 08 060336).

*Patent Abstracts of Japan*, vol. 12, No. 301, Aug. 16, 1988 (JP 63 075000).

* cited by examiner

*Primary Examiner*—Roy King
*Assistant Examiner*—Harry Wilkins
(74) *Attorney, Agent, or Firm*—Burr & Brown

(57) ABSTRACT

When a nitride film is formed on a substrate containing at least metallic aluminum, a fluctuation in forming a nitride film can be prevented, or the formation of the nitride film can be accelerated. A substrate containing at least metallic aluminum is subjected to a heating treatment in vacuum of $10^{-3}$ torrs or less, and subsequently it is subjected to a heating/nitriding treatment in an atmosphere (5) containing at least nitrogen. During the heating/nitriding treatment, porous bodies (3) and (4) through which nitrogen atoms-containing gases (A) and (B) can flow are contacted with the atmosphere (5).

16 Claims, 2 Drawing Sheets

PROCESS AND AN APPARATUS FOR NITRIDING AN ALUMINUM-CONTAINING SUBSTRATE

BACKGROUND OF THE INVENTION

1. Field of the invention

The present invention relates to a process and an apparatus for nitriding an aluminum-containing substrate.

2. Description of the Related Art

As wirings in the semiconductors and liquid crystal panels become finer, fine workings with dry processings are progressing. With the demand for such fine workings, halogen-based corrosive gases are used as film-forming gases or etching gases for the semiconductors or the like. On the other hand, it is known that aluminum nitride exhibits high corrosion resistance against such halogen-based corrosion gases. Therefore, members having aluminum nitride on their surfaces have been used in semiconductor-producing apparatuses, liquid crystal panel-producing apparatuses and the like. More specifically, there are available powdery aluminum nitride-sintered materials, in which an aluminum nitride film is formed on a substrate by using a vapor deposition technique such as CVD, and materials in which a surface of aluminum is modified and aluminum nitride is formed thereon.

When aluminum contacts air, its surface is oxidized to form a thin oxidized film. Since this oxidized film is an extremely stable passive phase, the surface of aluminum can not be nitrided by a simple nitriding method. Under these circumstances, the following methods have been specially developed to modify the surface of aluminum and form aluminum nitride thereon.

JP-A-60-211061 discloses a method in which after the inner pressure of the chamber is reduced to a given level and hydrogen or the like is introduced thereinto, discharging is conducted to heat the surface of aluminum to a given temperature, further argon gas is introduced and discharging is conducted to activate the surface of aluminum, and the surface of the aluminum is ionically nitrided through introducing nitrogen gas.

JP-A-7-166321 discloses a method in which a nitriding aid made of aluminum powder contacts the surface of aluminum, and aluminum nitride is formed on the surface of aluminum through heating in a nitrogen atoms-containing atmosphere.

However, according to the method described in JP-A-60-211061, since aluminum nitride is formed by using discharging, the entire device is complicated, which raises the costs. Further, it is difficult for this method to nitride members having complicated shapes or large sizes.

Furthermore, according to a method described in JP-A-7-166321, since a nitriding aid is used, voids exist in a resulting surface layer of aluminum nitride so that denseness is not sufficient. For this reason, it is an actual situation that corrosion resistance of the surface against the halogen-based corrosive gas is not sufficient and not practicable.

Moreover, when sintered aluminum nitride is to be used, it is needed to sinter aluminum nitride powder at a high temperature and the sintered body is difficult to be worked, thereby raising the cost. Further, it was extremely difficult to form members having large sizes or complicated shapes. In the case that an aluminum nitride layer is formed by a CVD process, aluminum nitride members having large sizes or complicated shapes are difficult to be formed, and the device and the process are complicated and expensive.

NGK Insulator, Ltd. discloses a technique in Japanese Patent Application No. 11-059011, in which a nitride film is formed on the surface of aluminum by heating the aluminum in the nitrogen atmosphere immediately after heating it in vacuum. However, depending on various conditions such as the shape of a container and the number of times of growing the films, the quality of the nitride film is degraded, or the growing rate of the film is decreased, or, in some cases, the nitride film is extremely difficult to be grown. For this reason, the technique may cause a disadvantageously large fluctuation as a nitride film producing method.

SUMMARY OF THE INVENTION

It is an object of the present invention to provide a process for producing a nitride film with a stable quality, when the nitride film is formed on an aluminum-containing substrate.

It is another object of the present invention to reduce a fluctuation in forming the nitride film, when the nitride film is formed on an aluminum-containing substrate.

The present invention relaxes to a process for nitriding a substrate containing at least metallic aluminum. The process includes the steps of heating the substrate in a vacuum of $10^{-3}$ torrs or less, and heating/nitriding the substrate in an atmosphere containing at least nitrogen continuously during the heating step. A porous body, through which a nitrogen atoms-containing gas can flow, is contacted with the nitrogen atmosphere during the heating/nitriding step.

The present invention also relates to an apparatus for nitriding a substrate containing at least metallic aluminum by the steps of heating a substrate containing at least metallic aluminum in vacuum of $10^{-3}$ torrs or less, and heating/nitriding the substrate in an atmosphere containing at least nitrogen continuously during the heating step. The apparatus includes a vessel for receiving the substrate arid enclosing the nitrogen-containing atmosphere during the heating/nitriding step, and at least a part of the vessel includes a porous body through which a nitrogen atoms-containing gas can flow.

The present invention also relates to an apparatus for nitriding a substrate containing at least metallic aluminum by the steps of heating a substrate containing at least metallic aluminum in vacuum of $10^{-}$ torrs or less, and heating/nitriding the substrate in an atmosphere containing at least nitrogen continuously during the heating step. The apparatus includes a vessel for receiving the substrate and enclosing the nitrogen-containing atmosphere during the heating/nitriding step, a gas-supplying path for supplying at least a nitrogen atoms-containing gas into the vessel and a porous body arranged in the path through which the nitrogen atoms-containing gas can flow.

BRIEF DESCRIPTION OF DRAWINGS

For a better understanding of the present invention, reference is made to the accompanying drawings, wherein:

FIG. 1(*b*) is a diagram showing a state in which a substrate 6 and an object 7 are placed in a dense vessel body 8 enclosed with a porous lid 3;

DETAILED DESCRIPTION OF THE INVENTION

Figure 1A:
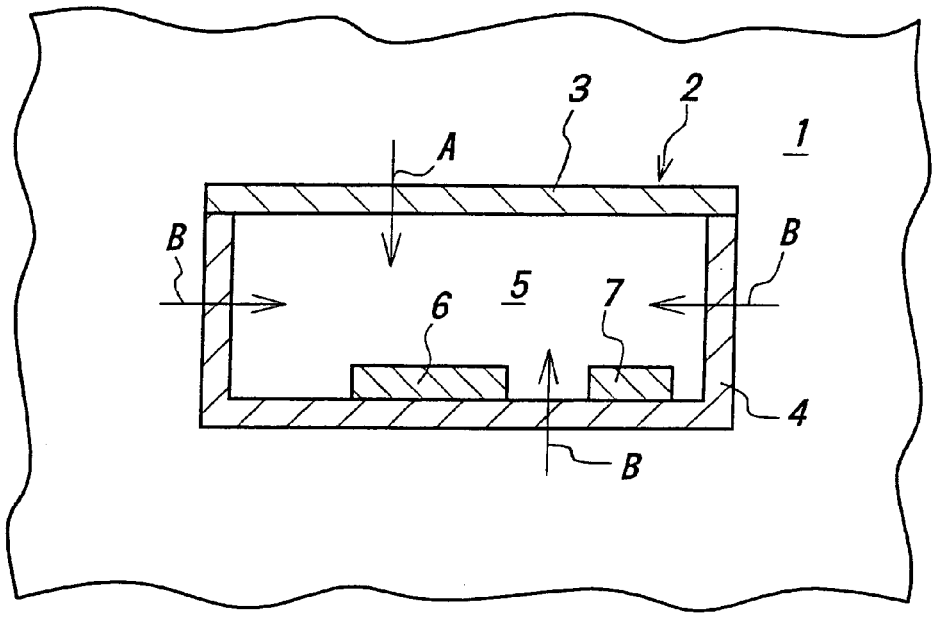
FIG. 1(*a*) is a diagram showing a state in which a substrate 6 and an object 7 are placed in a porous vessel body 4 enclosed with a porous lid 3.

The present inventors have repeated investigations strenuously to discover a new method for forming a nitride layer on a surface of a metallic aluminum-containing substrate in a simple manner. As a result, the present inventors discovered that a nitride film may be formed on a aluminum substrate made of a metallic aluminum by, for example, heating the substrate at a high vacuum degree before forming the nitride film. Although a reason for this is not clear, it is considered that an aluminum passive film on the surface of the aluminum substrate is removed by heating at the high vacuum degree.

An atmosphere in the vessel contained at least nitrogen during a heating/nitriding step. It was found that the nitride film was readily and stably formed on the substrate, or the growing rate of the nitride film was increased by contacting a porous body with the atmosphere during the heating/nitriding step. In some cases, it was observed that the quality of the thus formed nitride film tended to be improved.

The present inventors conducted various experiments to ascertain the reason for the above, and finally reached the following inference.

That is, in the case of the above-mentioned nitriding reaction, the nitriding reaction seems to be accelerated due to the presence of a vapor of a metallic element, such as magnesium, in an atmosphere. The metallic vapor in the atmosphere is considered to have an effect of reducing the passive film on the surface of the aluminum substrate, or to react with nitrogen in the atmosphere to form an intermediate compound. Such metal-nitrogen intermediate compound is considered to have an action of accelerating the nitriding reaction.

The inventors placed a metal source, such as a mass of metallic magnesium or alloys, in the vessel to accelerate the supply of such metallic element, and confirmed that the formation of the nitride film was thereby accelerated.

On the other hand, the nitride film tends to be difficult to form on the substrate, or the quality of the nitride film tends to be deteriorated, when the partial pressures of oxygen or water vapor in the vessel exceeds a given value, while the substrate is held at high temperature in vacuum. The present inventors observed chat a metal mass coexisted in the vessel when such interruption of the formation of the nitride film occurred. As a result, it was discovered that an oxide film was formed on the surface of the metal mass. Because the oxide film was thus formed on the surface of the metal mass, it was considered that the metallic vapor could not diffuse into the atmosphere and caused the incomplete formation of the nitride film. Such metal oxide film was produced due to increases in concentration of oxygen and water vapor existing in the atmosphere.

When the substrate was heated in the nitrogen atmosphere immediately and directly from the air without a pre-processing of holding the substrate in vacuum at a high temperature, the nitride film was not formed as well. Such phenomenon was similar to the above-mentioned incomplete formation of the nitride film due to the formation of the metal oxide film.

The present inventors also found that the above-mentioned metal oxide or hydroxide was formed in the atmosphere after the heating/nitriding step, when such incomplete formation of the nitride film was caused. MgO and $Mg(OH)_2$ may be recited by way of example as such a nitride-inhibitor. It is known that $Mg(OH)_2$ decomposes at about 350°C. to produce $H_2O$, and MgO reacts with the moisture in the air at room temperature to transform to $Mg(OH)_2$. Therefore, it is considered that the above-mentioned process of the incomplete formation of the nitride film is caused by the moisture supplied from such metal oxide and hydrogen oxide to the atmosphere.

Based on this hypothesis, the present inventors conceived to arrange a porous body to contact the atmosphere in the vessel during the heating/nitriding step, and, as a result, found it effective for reducing the passive film and for forming the nitride film.

It is considered that the surface of the porous body readily absorbs active metallic vapors, thereby having an effect of condensing metals on the surface of the vessel.

As mentioned above, an intermediate compound of a metal other than aluminum possibly intervenes in a reaction of forming the nitride film. Thus, it is considered that a gas phase-solid phase reaction is caused between the metal absorbed on the surface of the porous body and nitrogen by arranging the porous body to contact the atmosphere in the vessel during the heating/nitriding step. Since the gas phase-solid phase reaction has a larger cross-section area than that of a gas phase-gas phase reaction, said formation of the intermediate compound is considered to be accelerated.

In a preferred embodiment, the substrate is shielded from an external environment by the porous body.

As mentioned above, the concentration of the metallic vapor being larger than the given value is necessary for causing the nitriding reaction. The metallic vapor can be held on inner surfaces of pores of the porous body by shielding the substrate from the external environment with the porous body. Moreover, nitrogen can be introduced into the substrate through the porous body by substituting an external atmosphere with nitrogen. At this point, the metallic vapor held in the porous body reacts with nitrogen flowing through the porous body by the gas phase-solid phase reaction to form an intermediate compound as described above, which accelerates the nitriding reaction at the surface of the substrate.

In a preferred embodiment, the substrate is placed in a vessel having at least a lid made of the porous body. In this case, at least the lid of the vessel is exposed to a nitrogen atmosphere to introduce a nitrogen atoms-containing gas into the vessel through the lid.

In a preferred embodiment, the substrate is placed in a vessel made of the porous body. Therefore, an efficiency of the formation of the nitriding film can be improved.

In another preferred embodiment, when at least a nitrogen atoms-containing gas is supplied toward the substrate, the porous body is placed in a gas-supplying path for the nitrogen atoms-containing gas. By so placing, the above-mentioned gas phase-solid phase reaction can be accelerated inside the porous body in the gas-supplying path for the nitrogen atoms-containing gas.

In a preferred embodiment, the atmosphere with which the substrate is contacted contains a vapor of at least one metal selected from the group consisting of Group 2A, Group 3A, Group 4A and Group 4B in Periodic Table. These metallic vapors particularly accelerate the formation of the nitride film.

A method for incorporating the metallic vapor in the atmosphere is not particularly limited. In an embodiment, a metal or an alloy containing at least one metallic element selected from the group consisting of Group 2A, Group 3A, Group 4A and Group 4B in Periodic Table is placed in the vessel. In another embodiment, a metal or an alloy containing at least one metallic element of selected from the group consisting of Group 2A, Group 3A, Group 4A and Group 4B in Periodic Table is placed in the gas-supplying path for the nitrogen atoms-containing gas.

Among such metals, Mg, Sr, Ca, Ba, Be, Ce, Ti, Zr, B and Si are particularly preferred. More preferably, the metal contains magnesium or silicon.

These metals may be placed as an elemental substance to contact said atmosphere. Alternatively, as the above-mentioned alloy, an alloy containing two or more of these metals, or an alloy of the above metal(s) and aluminum is preferred. A6061 (Mg-Si based alloy), A7075 (Zn-Mg based alloy) and A5083 (Mg based alloy) may be recited by way of example as aluminum alloys.

The porosity of the porous body is preferably not less than 1%, more preferably not less than 3% to exert the above function and effect. The porosity of the porous body is preferably not more than 30% to maintain the vapor of the above-mentioned metal or the intermediate compound in the vessel at more than a certain amount.

A pore size of the porous body is preferably not less than 1 $\mu$m, more preferably not less than 3 $\mu$m to capture the metallic vapor and to flow the nitrogen atoms-containing gas through it. The pore size of the porous body is preferably not more than 100 $\mu$m to maintain the vapor of the above-mentioned metal or the intermediate compound in the vessel at more than a certain amount, and to secure a reaction surface area on which said intermediate compound is formed.

The material of the porous body is not particularly limited, but it is necessary to have no possibility to diffuse oxygen or other nitriding inhibitors during the nitriding treatment.

Graphite free from impurities is preferably used as a material forming the porous body. Other than this, for example, nitrides such as silicon nitride or aluminum nitride, and carbide such as silicon carbide are preferably used as a porous ceramic material.

It is considered that graphite is highly reactive with oxygen, thereby having an effect of reducing a partial pressure of oxygen in the atmosphere. Since oxygen and water molecules are considered to have an effect of inhibiting the nitriding reaction from said mechanism, their partial pressure is preferably reduced as much as possible. When a vessel made of graphite is actually used, the producing rate of the film exhibited an advantage over the case of using a vessel made of porous silicon carbide.

According to the present invention, after the substrate is heated in vacuum, the nitrogen atoms-containing gas is supplied to the vessel to conduct the heating/nitriding treatment, while maintaining the vacuum state.

According to the present invention, the substrate needs to be heated under vacuum of not more than $10^{-3}$ torrs, and preferably not more than $5\times10^{-3}$ torrs.

The lower limit of the pressure in vacuum is not particularly limited, but it is preferably $10^{-6}$ torrs, and more preferably $10^{-5}$ torrs. A larger pump and a higher-vacuum tolerant chamber are necessary to achieve a higher vacuum degree, thereby raising the cost. Further, such a lower limit does not affect the nitride-forming rate.

The lower limit for the temperature of the heating treatment is not particularly limited as far as even a portion of an oxide coating on the surface of the substrate may be removed. However, to efficiently generate and keep the vapor of the above-mentioned metal or the intermediate compound and to efficiently destroy the oxide coating, the lower temperature limit is preferably 450° C., and more preferably 500° C.

The upper limit of the temperature in the heating treatment is preferably 650° C., and more preferably 600° C., when the melting point of an aluminum alloy used for the substrate is taken into account. By so setting, thermal deformation of the substrate can be prevented.

$N_2$ gas, $NH_3$ gas and $N_2/NH_3$ mixed gas may be recited by way of example as the nitrogen atoms-containing gas. Particularly, it is preferable to contain $N_2$ gas.

In order to form a thick nitride film on the heating-treated substrate in a relatively short time, the pressure of the nitrogen atoms-containing gas is preferably set at 1 kg/cm$^2$ or more, more preferably in a range from 1 to 2000 kg/cm$^2$, and particularly preferably in a range from 1.5 to 9.5 kg/cm$^2$.

The heating temperature in the heating/nitriding treatment is not particularly limited as far as the nitride film may be formed on the surface of the substrate. However, to form a relatively thick nitride film in a relatively short time, the lower limit of the heating temperature is preferably 450° C., and more preferably 500° C.

Further, the upper limit of the heating temperature in the heating/nitriding treatment is preferably 650° C., and more preferably 600° C. By so setting, thermal deformation of the substrate can be effectively prevented.

The nitride thus formed on the surface of the substrate is not necessarily present in the form of a layer or a film. That is, the form is not limited as far as the nitride is formed in such a state that it can afford corrosion resistance on the substrate itself. Therefore, the form includes a state in which fine particles are densely dispersed or a state in which the composition of the nitride inclines toward the substrate with an interface between the nitride and the substrate being unclear.

When the nitride film is formed after the substrate or the surface of the substrate being coated, the surface is required to contain at least metallic aluminum. It is because aluminum nitride is formed on the surface by nitriding the metallic aluminum.

Preferably, the substrate is at least one selected from the group consisting of a metal containing at least metallic aluminum, an intermetallic compound containing aluminum atoms, a composite material of the metal containing at least aluminum and the intermetallic compound containing aluminum atoms, a composite material of the metal containing at least aluminum and a low heat expansion material, and a composite material of the metal containing at least aluminum, the intermetallic compound containing aluminum atoms and the low heat expansion material.

As the low expansion material, AlN, SiC, $Si_3N_4$, $Al_2O_3$, Mo, W and carbon may be recited by way of example. These materials are effective in controlling the physical and mechanical properties of the composite material. The content of the low thermal expansion material is preferably in a range from 10 to 70 vol %.

As the metal containing at least aluminum, pure metallic aluminum or alloys of aluminum and other metal(s) may be used. As the metals alloyed with aluminum, metals comprising at least one selected from elements such as Mg, Sr, Ca, Ba and Be in Group 2A in Periodic Table, elements such as Ce in Group 3A in Periodic Table, elements such as Ti and Zr in Group 4A in Periodic Table, and elements such as B and Si in Group 4B in Periodic Table are preferred from the standpoint of being effective for removing the oxide film and accelerating the formation of the nitride film.

A6061 (Mg-Si based alloy), A7075 (Zn-Mg based alloy) and A5083 (Mg based alloy) may be recited as specific examples for the aluminum alloy constituting the substrate.

As the intermetallic compound containing aluminum atoms, $Al_3Ni$, $Al_3Ni_2$, AlNi, $AlNi_3$, $AlTi_3$, AlTi, $Al_3Ti$, etc. may be recited by way of example.

As the substrate, composite materials in which a member made of a metal, a ceramic material and a composite material thereof are surface-coated with aluminum or an aluminum alloy may be used.

The nitride formed on the surface of the substrate preferably contains at least one element selected from the group consisting of metals of Group 2A, Group 3A, Group 4A and Group 4B in Periodic Table at a higher concentration than in the surface of a metallic portion of metallic aluminum in the substrate.

The content of at least one element selected from the group consisting of metals of Group 2A, Group 3A, Group 4A and Group 4B in Periodic Table is preferably not less than 1.1 times, and more preferably not less than 1.5 times as much as that in the metallic aluminum in the substrate.

Further, at least one element selected from the group consisting of metals of Group 2A, Group 3A, Group 4A and Group 4B in Periodic Table and the oxygen content are dispersed in the nitride uniformly in the thickness direction thereof from the standpoint of stabilizing the stress concentration, heat fatigue and mechanical properties.

The nitride having the above-mentioned oxygen content distribution and containing at least one element selected from the group consisting of metals of Group 2A, Group 3A, Group 4A and Group 4B in Periodic Table has excellent corrosion resistance as a protective film, since fluoride formed by these elements on exposing to fluorine atmosphere has small vapor pressure. For this reason, when the nitride is exposed to the above-mentioned corrosive gas, change in weight of the nitride is extremely small substrate and particularly extremely smaller as compared with a case where the substrate is exposed to the corrosive gas.

In order that the nitride containing at least one element selected from the group consisting of metals of Group 2A, Group 3A, Group 4A and Group 4B in Periodic Table may have high hardness, high toughness and high corrosion resistance, the thickness of the nitride is preferably not less than 2 $\mu$m, more preferably not less than 5 $\mu$m.

To conduct the present invention, for example, a substrate is placed on a sample table inside a chamber equipped with a vacuum device. Next, this chamber is evacuated with the vacuum pump until a given vacuum degree is achieved. Then, the substrate is heated with a heater, such as a resistant heating element or an infrared lamp arranged in the chamber, until heated to a given temperature. The substrate is kept at this temperature for 1 to 10 hours. In the heating treatment, the entire substrate does not need to reach that temperature, but at least a surface portion of the substrate on which a passive film is formed reached this given temperature.

After the heating treatment, the interior of the chamber is replaced with a nitrogen gas atmosphere by introducing the nitrogen gas or the like into the chamber. By adjusting the input power of the heater, the substrate is heated to a given temperature. Then, the substrate is hold at this temperature for 1 to 30 hours. Also in this case, the entire substrate does not need to reach the given temperature, but at least a surface portion of the substrate on which the nitride film is to be formed reaches the given temperature.

After the given time has passed, the heating/nitriding treatment is terminated by controlled cooling or by cooling the furnace. Then, the substrate is taken out from the chamber.

The nitriding-treated substrate according to the present invention can be used as a component in the semiconductor-producing apparatuses, the liquid crystal-producing apparatuses, the automobiles, etc.

Further, the nitriding-treated substrate according to the present invention has excellent heat emission property. Therefore, the nitriding-treated substrate according to the present invention can be favorably used in a heat emission component requiring the heat emitting property.

Figure 1B:
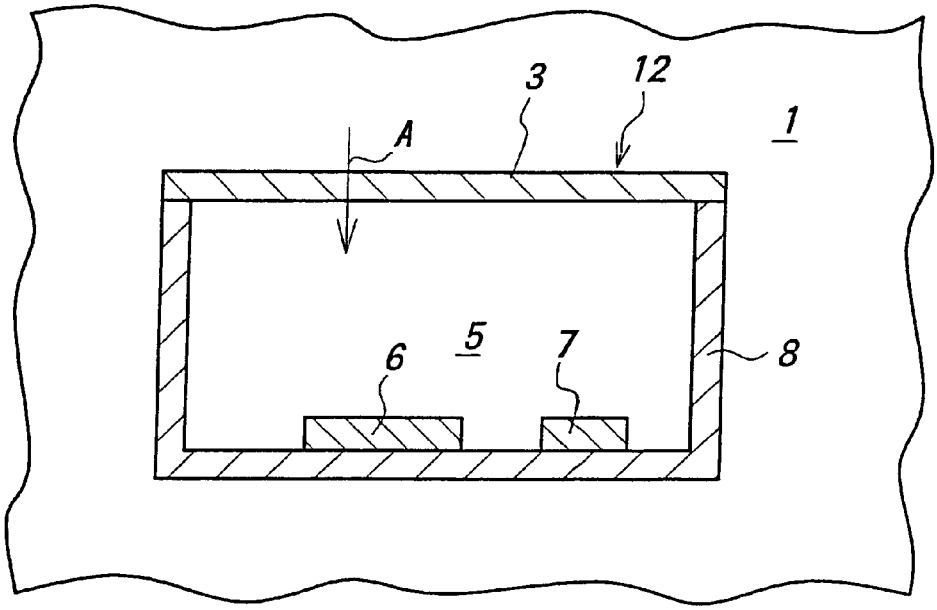

Referring to FIG. 1(*a*), a vessel 2 made of a porous body is placed in an atmosphere 1 containing at least a nitrogen atoms-containing gas. The vessel 2 consists of a lid 3 and a vessel body 4. During the heating/nitriding treatment, at least the nitrogen atoms-containing gas is supplied from the atmosphere 1 to the interior atmosphere 5 in the directions as indicated by the arrows A and B. In the vessel body 4, the substrate 6, an object 7 made of a metal containing at least one element selected from the group consisting of metals of Group 2A, Group 3A, Group 4A and Group 4B in Periodic Table, or an alloy thereof are placed. In this state, the substrate is subjected to the heating/nitriding treatment.

Referring to FIG. 1(*b*), a vessel body 8 of a vessel 12 is made of a dense body, and a lid 3 is made of a porous body.

Figure 2:
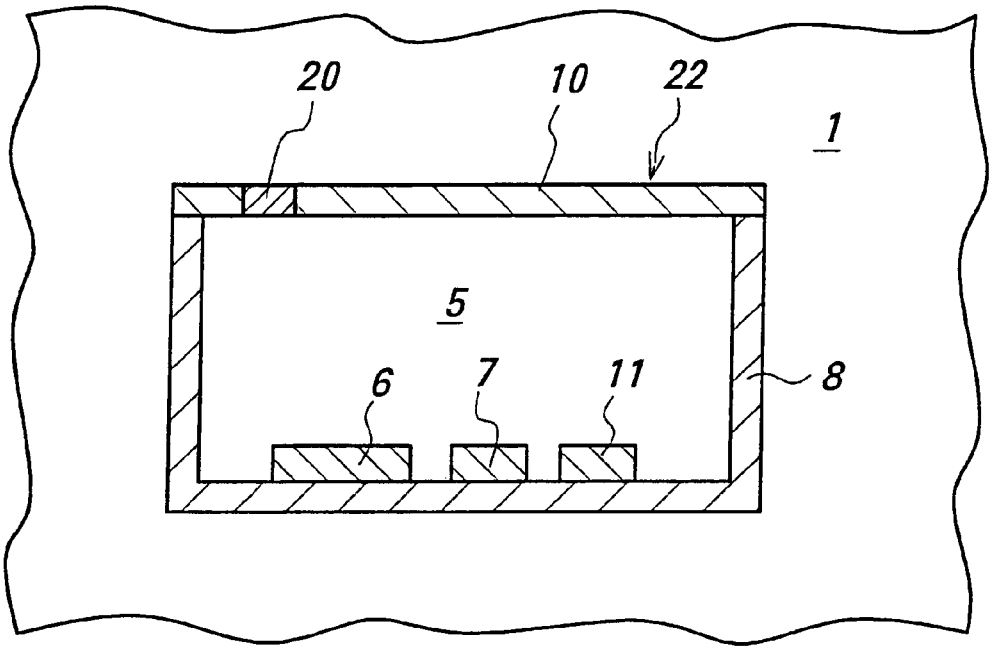
FIG. 2 is a diagram showing a state in which a substrate 6, an object 7 and a porous body 11 are placed in a dense vessel body 8 enclosed with a dense lid 10.

Referring to FIG. 2, both of a vessel body 8 and a lid 10 of a vessel 22 are made of a dense body. For example, the lid 10 is equipped with a valve 20. A substrate 6, the above-mentioned object 7 and a porous body 11 are placed in the vessel body 8. In this state, the substrate is heated in vacuum, and then the nitrogen atoms-containing gas is introduced through the valve 20 to conduct the heating/nitriding treatment.

Figure 3:
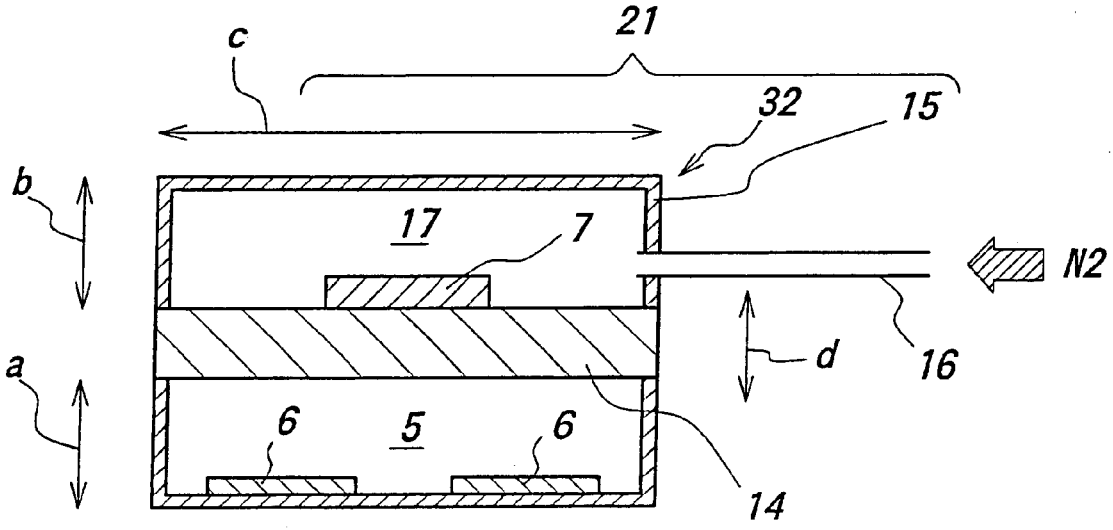
FIG. 3 is a diagram showing a state in which a vessel 32 is divided by a shield plate 14 and an object 7 is placed in a nitrogen-supplying path 21.

Referring to FIG. 3, a shield plate 14 made of a porous body is placed in a vessel 32 comprising a dense body 15 to divide the inner space of the vessel 32 into, for example, two spaces 5 and 17. A substrate 6 is placed in an atmosphere 5. The above-mentioned object 7 is placed in an atmosphere 17. A supply tube 16 is connected to be able to communicate with the atmosphere 17, for example, a nitrogen gas is supplied into the atmosphere 17 through the supply line 16. The substrate 6 is shielded from the external atmosphere by the shield plate 14, and the set object 7 is placed in the supplying path 21 for the nitrogen gas.

EXAMPLES

In the following, the present invention will be explained based on specific examples.

Experiment 1

An aluminum substrate was nitrided according to conditions of vacuum heat treatment and heating/nitriding treatment as shown in Table 1. More specifically, pure aluminum (A1050: A1 content >99.5%) and a Mg-Si based Al alloy (A6061: 1 Mg-0.6Si-0.2Cr-0.3Cu), both of which had dimensions of 20×20×2 mm, were used as the substrates. The reaction vessel was prepared as follows.

Examples 1 and 5

A Combination of a cup-shaped vessel body 4 made of graphite (porosity 10%) and a lid 3 made of graphite (porosity 10%, screw type) as shown in FIG. 1(*a*) was used.

Examples 2 and 6

A combination of a cup-shaped vessel body 8 made of SUS (SUS-304) and a lid 3 made of graphite as shown in FIG. 1(*b*) was used.

Examples 3 and 7

A combination of a cup-shaped vessel body 8 made of SUS (SUS-304) and a lid 10 made of SUS was used. A block 11(20×20×5 mm) made of graphite having a porosity of 10% was placed in a vessel 22.

Examples 4 and 8

A combination of a lid 3 made of a recrystallized silicon carbide porous body (porosity 20%, pore size 60 cm) and a vessel body 4 as shown in FIG. 1(*a*) was used.

All of the vessels had dimensions of 90 mm in inner diameter and 7 mm in height, in the form of a cup. The vessels were pre-treated in the following manners.

In the case of the vessel made of graphite: heated at 2000° C. in not more than $1\times10^{-3}$ torrs for 2 hours.

In the case of the vessel made of recrystallized silicon carbide: heated at 1500° C. in not more than $1\times10^{-3}$Torrs for 2 hours.

In the case of the vessel made of SUS: no pre-treatment.

Each three of A1050 and A6061 substrates were placed in the above-mentioned reaction vessel. Each of the reaction vessels was placed in an electric furnace equipped with a graphite heater, and the furnace was evacuated to a vacuum degree given in Table 1 with a vacuum pump. Then, the substrate was heated to a temperature given in Table 1 by passing current through the graphite heater, and the vacuum degree was held at this temperature for a period of time given in Table 1 (heating treatment under vacuum).

Thereafter, nitrogen gas was introduced into the electric furnace to reach a set pressure given in Table 1. After the pressure was achieved, the nitrogen gas was introduced at a rate of 2 liter/min., and an inside pressure of the furnace was controlled to the set pressure with ±0.05 kg/cm$^2$. Then, the temperature and the holding time for the substrate was set as shown in Table 1, and a nitride film was formed on the surface of the substrate (heating/nitriding treatment).

When the nitride film-formed substrate was cooled to 50° C. or less, the substrate was taken out from the chamber.

TABLE 1

| | Heating condition | | | Heating/Nitriding condition | | | |
|---|---|---|---|---|---|---|---|
| | | | | Pressure of | | | Reaction vessel |
| Example | Vacuum degree (Torr) | Heating temperature (° C.) | Heating time (hr) | nitrogen gas atmosphere (kgf/cm$^2$) | Heating temperature (° C.) | Heating time (hr) | Material of vessel body |
| 1 | $1.2\times10^{-4}$ | 540 | 2 | 9.5 | 540 | 2 | Graphite, porosity 10% |
| 2 | $1.3\times10^{-4}$ | 540 | 2 | 9.5 | 540 | 2 | Stainless steel (SUS304) |
| 3 | $1.1\times10^{-4}$ | 540 | 2 | 9.5 | 540 | 2 | Stainless steel (SUS304) |
| 4 | $1.3\times10^{-4}$ | 540 | 2 | 9.5 | 540 | 2 | Recrystallized SiC, porosity 10% |
| 5 | $1.2\times10^{-4}$ | 540 | 2 | 1 | 540 | 8 | Graphite, porosity 10% |
| 6 | $1.2\times10^{-4}$ | 540 | 2 | 1 | 540 | 8 | Stainless steel (SUS304) |
| 7 | $1.3\times10^{-4}$ | 540 | 2 | 1 | 540 | 8 | Stainless steel (SUS304) |
| 8 | $1.2\times10^{-4}$ | 540 | 2 | 1 | 540 | 8 | Recrystallized SiC, porosity 10% |

| | Reaction vessel | | | | | |
|---|---|---|---|---|---|---|
| Example | Dimension of vessel body | Material of lid | Dimension of lid | Pre-treatment | Material of porous body | Dimension of porous body |
| 1 | Inner diameter 90 mm, Height 7 mm | Graphite, porosity 10% | Outer diameter 100 mm, Height 5 mm | Baking at 2000° C. | — | — |
| 2 | Inner diameter 90 mm, Height 7 mm | Graphite, porosity 10% | Outer diameter 100 mm, Height 5 mm | Baking only lid at 2000° C. | — | — |
| 3 | Inner diameter 90 mm, Height 7 mm | Stainless steel (SUS304) | Outer diameter 100 mm, Height 5 mm | Baking porous body | Graphite, porosity 10% | 20 × 20 × 5 mm |
| 4 | Inner diameter 90 mm, Height 7 mm | Recrystallized SiC, porosity 20% | Outer diameter 100 mm, Height 5 mm | Baking at 1500° C. | — | — |
| 5 | Inner diameter 90 mm, Height 7 mm | Graphite, porosity 10% | Outer diameter 100 mm, Height 5 mm | Baking at 2000° C. | — | — |
| 6 | Inner diameter 90 mm, Height 7 mm | Graphite, porosity 10% | Outer diameter 100 mm, Height 5 mm | Baking only lid at 2000° C. | — | — |

TABLE 1-continued

| | | | | | | |
|---|---|---|---|---|---|---|
| 7 | Inner diameter 90 mm, Height 7 mm | Stainless steel (SUS304) | Outer diameter 100 mm, Height 5 mm | Baking porous body | Graphite, porosity 10% | 20 × 20 × 5 mm |
| 8 | Inner diameter 90 mm, Height 7 mm | Recrystallized SiC, porosity 20% | Outer diameter 100 mm, Height 5 mm | Baking at 1500° C. | — | — |

The surface color of each of the obtained substrates was blackish brown or gray. A color tone of the nitrided substrate is shown in Tables 2 and 3. The surface of the nitrided substrate was subjected to the X-ray diffraction, so peaks of aluminum nitride were observed.

The surface of the substrate was also subjected to an EDS analysis, so N, Mg and Si as well as A1 were detected. The measured quantities of the EDS analysis are shown in Tables 2 and 3. As the EDS analysis equipment, a combination of an SEM (Model XL-30) manufactured by Philips Co., Ltd. and an EDS detector (Model CDU-SUTW) manufactured by EDAX Co., Ltd was used. The plane analysis was conducted at an acceleration voltage of 20kV and a magnification of 1000×. As clearly shown in Table 2 and 3, the measured quantities of N were generally in the following relation, which varied depending on the type of the reaction vessel and the nitriding condition. (the vessel body made of porous graphite+the porous lid)>(the vessel body made of recrystallized silicon carbide+the lid made of recrystallized silicon carbide)>(the vessel body made of SUS+the lid made of porous graphite)>(the vessel body made of SUS+the lid made of SUS+the block made of porous graphite)

The thickness of the nitride film was examined with an SEM observation of the cross-section of the nitride film. The results are shown in Table 2 and 3.

As clearly shown in Table 2 and 3, the thicknesses of the nitride film were generally in the following relation, which were varied depending on the type of the reaction vessel and the nitriding condition.

From the above-mentioned result, it is suggested that the nitriding reaction is accelerated by shielding the furnace atmosphere and the substrate with the porous body upon nitriding. It is also confirmed that the nitriding reaction is caused by putting a porous body near the substrate.

TABLE 2

| Example | Substrate | X-ray diffraction Crystal phase | Cross section observation Thickness of nitride film (μm) | EDS analysis N | Mg | Al | Si | Appearance Color | Bubbling test (5 min) Etching rate (mg/cm²) |
|---|---|---|---|---|---|---|---|---|---|
| 1 | Mg—Si based Al alloy A6061 | AlN, Al | 20 | 20.63 | 4.25 | 68.38 | 6.75 | Grayish brown | 0.01 |
| | Pure Al (>99.5%) A1050 | AlN, Al | 96 | 23.42 | 1.096 | 73.42 | 2.055 | Black | 0.02 |
| 2 | Mg—Si based Al alloy A6061 | AlN, Al | 13 | 14.47 | 3.781 | 76.14 | 5.606 | Gray | 0.06 |
| | Pure Al (>99.5%) A1050 | AlN, Al | 41 | 16.69 | 1.043 | 80.7 | 1.565 | Gray | 0.05 |
| 3 | Mg—Si based Al alloy A6061 | AlN, Al | 8 | 12.2 | 4.662 | 76.2 | 6.917 | Gray | 0.21 |
| | Pure Al (>99.5%) A1050 | AlN, Al | 24 | 12.47 | 0.864 | 85.19 | 1.481 | Gray | 0.17 |
| 4 | Mg—Si based Al alloy A6061 | AlN, Al | 15 | 17.21 | 5.776 | 71.12 | 5.897 | Grayish brown | 0.04 |
| | Pure Al (>99.5%) A1050 | AlN, Al | 57 | 23.45 | 1.622 | 72.86 | 2.065 | Black | 0.03 |
| 5 | Mg—Si based Al alloy A6061 | AlN, Al | 6 | 30.61 | 1.208 | 66.97 | 1.208 | Grayish brown | 0.05 |
| | Pure Al (>99.5%) A1050 | AlN, Al | 60 | 26.64 | 1.11 | 71.95 | 0.303 | Black | 0.00 |

TABLE 3

| Example | Substrate | X-ray diffraction Crystal phase | Cross section observation Thickness of nitride film (μm) | EDS analysis N | Mg | Al | Si | Appearance Color | Bubbling test (5 min) Etching rate (mg/cm²) |
|---|---|---|---|---|---|---|---|---|---|
| 6 | Mg—Si based Al alloy A6061 | AlN, Al | 3 | 24.18 | 2.449 | 71.73 | 1.633 | Gray | 0.34 |
| | Pure Al (>99.5%) A1050 | AlN, Al | 20 | 18.58 | 1.218 | 79.9 | 0.305 | Gray | 0.18 |

TABLE 3-continued

| Example | Substrate | X-ray diffraction Crystal phase | Cross section observation Thickness of nitride film (μm) | EDS analysis N | Mg | Al | Si | Appearance Color | Bubbling test (5 min) Etching rate (mg/cm²) |
|---|---|---|---|---|---|---|---|---|---|
| 7 | Mg—Si based Al alloy A6061 | AlN, Al | 2 | 15.2 | 2.938 | 80.14 | 1.722 | Gray | 0.52 |
| | Pure Al (>99.5%) A1050 | AlN, Al | 14 | 13.3 | 0.771 | 85.99 | 0 | Gray | 0.23 |
| 8 | Mg—Si based Al alloy A6061 | AlN, Al | 5 | 25.58 | 2.843 | 70.05 | 1.523 | Grayish brown | 0.02 |
| | Pure Al (>99.5%) A1050 | AlN, Al | 16 | 21.97 | 1.093 | 76.61 | 0.328 | Gray | 0.05 |

Experiment 2

A film was formed according to Examples 1–4 and 5–8, except that a combination of a vessel and a lid (screw type) both of which were made of SUS 304 (in Comparative Examples 1 and 3), or a combination of a vessel body and a lid both of which were each made of a AlN dense sintered body (in Comparative Examples 2 and 4) was used as the vessel. Specific conditions of the heating treatment and the heating/nitriding treatment are shown in Table 4.

TABLE 4

| Example | Heating condition: Vacuum degree (Torr) | Heating temperature (° C.) | Heating time (hr) | Heating/Nitriding condition: Pressure of nitrogen gas atmosphere (kgf/cm²) | Heating temperature (° C.) | Heating time (hr) | Reaction vessel: Material of vessel body |
|---|---|---|---|---|---|---|---|
| 1 | $1.2 \times 10^{-4}$ | 540 | 2 | 9.5 | 540 | 2 | Stainless steel (SUS304) |
| 2 | $1.0 \times 10^{-4}$ | 540 | 2 | 9.5 | 540 | 2 | AlN |
| 3 | $1.0 \times 10^{-4}$ | 540 | 2 | 1 | 540 | 2 | Stainless steel (SUS304) |
| 4 | $1.2 \times 10^{-4}$ | 540 | 2 | 1 | 540 | 2 | AlN |

| Example | Reaction vessel: Dimension of vessel body | Material of lid | Dimension of lid | Pre-treatment | Material of porous body |
|---|---|---|---|---|---|
| 1 | Inner diameter 90 mm, Height 7 mm | Stainless steel (SUS304) | Outer diameter 100 mm, Height 5 mm | None | None |
| 2 | Inner diameter 90 mm, Height 7 mm | AlN | Outer diameter 100 mm, Height 5 mm | Baking at 1500° C. | None |
| 3 | Inner diameter 90 mm, Height 7 mm | Stainless steel (SUS304) | Outer diameter 100 mm, Height 5 mm | None | None |
| 4 | Inner diameter 90 mm, Height 7 mm | AlN | Outer diameter 100 mm, Height 5 mm | None | None |

A surface of each of the obtained substrates was subjected to the X-ray diffraction. In Comparative Examples 1, 3 and 4, although slight peaks of AlN were observed in both of A1050 and A6061, they were extremely smaller than in Example 1–8. In Comparative Example 2, no peak of AlN was observed in both of the substrate.

A surface of each of the obtained substrates was subjected to the EDS analysis. In all of Comparative Examples 1–4, N, Mg and Si were detected, but the measured quantities of N were smaller than in Example 1–8. The measured quantities are shown in Table 5.

The thickness of the nitride film was also examined with the SEM observation of the cross-section of the nitride film. Almost identical thicknesses were obtained in Comparative Examples 1, 3 and 4, but these thicknesses were extremely thinner than in Example 1–8. In Comparative Example 2, the nitride film could not be observed, when A6061 was used as the substrate.

TABLE 5

| Comparative Example | Substrate | X-ray diffraction Crystal phase | Cross section observation Thickness of nitride film (μm) | EDS analysis N | Mg | Al | Si | Appearance Color | Bubbling test (5 min) Etching rate (mg/cm²) |
|---|---|---|---|---|---|---|---|---|---|
| 1 | Mg—Si based Al alloy A6061 | AlN, Al | 1 | 6.4 | 2.1 | 90.3 | 1.2 | White | 1.95 |
| | Pure Al (>99.5%) A1050 | AlN, Al | 2 | 11.2 | 1 | 87.7 | 0.1 | White | 0.77 |
| 2 | Mg—Si based Al alloy A6061 | Al | None | 7.1 | 2.6 | 88.8 | 1.5 | White | 2.42 |
| | Pure Al (>99.5%) A1050 | Al | 1 | 9.2 | 1.1 | 89.4 | 0.3 | White | 0.91 |
| 3 | Mg—Si based Al alloy A6061 | AlN, Al | 2 | 8.2 | 3.1 | 87 | 1.7 | White | 0.88 |
| | Pure Al (>99.5%) A1050 | AlN, Al | 2 | 15.7 | 1.3 | 82.6 | 0.4 | White | 0.29 |
| 4 | Mg—Si based Al alloy A6061 | AlN, Al | <1 | 6.1 | 2.4 | 90 | 1.5 | White | 1.01 |
| | Pure Al (>99.5%) A1050 | AlN, Al | 1 | 7.1 | 0.9 | 91.6 | 0.4 | White | 0.34 |

With the results obtained from Example 1–8 and Comparative Example 1–4, it was confirmed that shielding the substrate from the external atmosphere with the porous material was effective in accelerating the nitriding reaction as a forming condition of the nitride film.

Experiment 3

A reaction vessel as shown in FIG. 3 was made, and a nitride film was formed according to a nitriding condition given in Table 6. As a substrate, pure aluminum (A1050: A1 content >99.5%) having dimensions of 20×20×2 mm was used. Referring to FIG. 3, a plate made of porous graphite (porosity 10%, pore size 60 μm) was used as a shield plate 14. A cylindrical reaction vessel made of SUS 304 was used as a vessel 32. Nitrogen gas was supplied into the vessel 32 with a supplying tube 16 made of SUS 304. A substrate was placed in a lower room 5 of the vessel 32, and an object 7 made of pure magnesium (Mg content 99.9%) and having dimensions of 20×20×2 mm and a weight of 1.4 g was placed on the shield plate 14. The distances a, b, c and d were 7 mm, 7 mm, 20 mm and 5 mm, respectively.

A color of the obtained substrate was black. A formation of a nitride film was observed with the X-ray diffraction. The surface of the obtained substrate was subjected to the EDS analysis, and N and Mg were detected. The thickness of the nitride film was examined with the SEM observation of the cross-section of the nitride film. The results are shown in Table 7.

TABLE 6

| Example | Heating condition: Vacuum degree (Torr) | Heating temperature (° C.) | Heating time (hr) | Heating/Nitriding condition: Pressure of nitrogen gas atmosphere (kgf/cm²) | Heating temperature (° C.) | Heating time (hr) | Reaction vessel: Material of vessel body | Dimension of vessel body | Material of lid | Dimension of lid | Pre-treatment | Material of porous body | Dimension of porous body |
|---|---|---|---|---|---|---|---|---|---|---|---|---|---|
| 9 | 1.1 × 10⁻⁴ | 540 | 2 | 9.5 | 540 | 2 | Stainless Steel/ Graphite See FIG. 3 | ID: 90 mm, H: 7 mm | Stainless steel See FIG. 3 | OD: 100 mm, H: 5 mm | Baking only graphite member at 2000° C. | — | — |
| 10 | 1.0 × 10⁻⁴ | 540 | 2 | 1 | 540 | 8 | Stainless Steel/ Graphite See FIG. 3 | ID: 90 mm, H: 7 mm | Stainless steel See FIG. 3 | OD: 100 mm, H: 5 mm | Baking only graphite member at 2000° C. | — | — |

TABLE 7

| Example | Substrate | X-ray diffraction Crystal phase | Cross section observation Thickness of nitride film (μm) | EDS analysis N | Mg | Al | Si | Appearance Color | Bubbling test (5 min) Etching rate (mg/cm²) |
|---|---|---|---|---|---|---|---|---|---|
| 9 | Pure Al (>99.5%) A1050 | AlN, Al | 162 | 35.46 | 2.737 | 61.57 | 0.228 | Black | <0.01 |

TABLE 7-continued

| Example | Substrate | X-ray diffraction Crystal phase | Cross section observation Thickness of nitride film (μm) | EDS analysis N | Mg | Al | Si | Appearance Color | Bubbling test (5 min) Etching rate (mg/cm²) |
|---|---|---|---|---|---|---|---|---|---|
| 10 | Pure Al (>99.5%) A1050 | AlN, Al | 54 | 40.18 | 2.886 | 56.6 | 0.333 | Black | <0.01 |

Bubbling Test

A bubbling test was conducted with 36% HCl to evaluate soundness of the nitride films of Examples 1–10 and Comparative Example 1–4. 40 ml of 36% HCl was measured in a 50 ml beaker, and the nitrided substrate was immersed into HCl in the beaker for 5 minutes. The soundness of the nitride film was evaluated with a weight change and a bubbling state of the substrate. Since the substrate was not etched by HCl, the bubbles were not generated where the aluminum nitride film was present. However, where the nitride film was thin, or where the substrate was insufficiently nitrided, HCl penetrated into and dissolved A1 substrate to cause an etching phenomenon. The soundness was evaluated by comparing etching rates (amounts of weigh losses per unit areas).

The etching rates of Examples 1–10 and Comparative Examples 1–4 are shown in Tables 2, 3, 5 and 7. As clearly shown in each of the tables, the etching rates of Comparative Examples 1–4 had tendency to be extremely higher than in Examples 1–10. The etching rate exhibited an extremely high value, when the nitride film was extremely thin so that the film could not be confirmed with the SEM observation, such as in the case of using the substrate of A6061 in Comparative Example 2.

As a result, it was found that the soundness of the nitride film was enhanced by shielding the substrate from the outer atmosphere with the porous body.

As having been described in the above, according to the present invention, while the nitride film is formed on the metallic aluminum containing substrate, fluctuations in a state of the nitride film formation can be prevented, or the formation of the nitride film can be accelerated.

What is claimed is:

1. An apparatus for nitriding a substrate containing at least metallic aluminum byte steps of heating a substrate containing at least metallic aluminum in vacuum of $10^{-}$ torrs or less, and heating/nitriding the substrate in an atmosphere containing at least nitrogen continuously during said heating step, said apparatus comprising a vessel for receiving said substrate and enclosing said nitrogen-containing atmosphere during said heating/nitriding step, at least a part of said vessel comprising a porous body through which a nitrogen atoms-containing gas can flow, and one of a metal and an alloy positioned in said vessel and spaced (torn said substrate, said one of a metal and an alloy comprising at least one metallic element selected from the group consisting of Group 2A, Group 3A and Group 4A of the Periodic Table.

2. An apparatus for nitriding a substrate containing at least metallic aluminum according to claim 1, wherein said vessel comprises at least a lid made of said porous body.

3. An apparatus for nitriding a substrate containing at least metallic aluminum according to claim 2, wherein said vessel is entirely made of said porous body.

4. An apparatus for nitriding a substrate containing at least metallic aluminum according to claim 1, wherein a porosity of said porous body is in a range of 1–30%.

5. An apparatus for nitriding a substrate containing at least metallic aluminum according to claim 1, wherein a porosity of said porous body is in a range of 1–30%.

6. An apparatus for nitriding a substrate containing at least metallic aluminum according to claim 1, wherein a pore size of said porous body is in a range of 1–100 μm.

7. An apparatus for nitriding a substrate containing at least metallic aluminum according to claim 1, wherein a pore size of said porous body is in a range of 1–100 μm.

8. An apparatus for nitriding a substrate containing at least metallic aluminum according to claim 1, wherein said porous body is made of graphite.

9. An apparatus for nitriding a substrate containing at least metallic aluminum according to claim 1, wherein said porous body is made of graphite.

10. An apparatus for nitriding a substrate containing at least metallic aluminum according to claim 1, wherein said porous body is made of a ceramic material.

11. An apparatus for nitriding a substrate containing al least metallic aluminum according to claim 1, wherein said porous body is made of a ceramic material.

12. An apparatus for nitriding a substrate containing at least metallic aluminum according to claim 1, wherein said nitrogen atoms-containing gas is introduced into said vessel through said porous body.

13. An apparatus for nitriding a substrate containing at least metallic aluminum by the steps of heating a substrate containing at least metallic aluminum in vacuum of $10^{-3}$ torrs or less, and heating/nitriding the substrate in an atmosphere containing at least nitrogen continuously during said heating step, said apparatus comprising a vessel for receiving said substrate and enclosing said nitrogen-containing atmosphere during the heating/nitriding step, a gas-supplying path for supplying at least a nitrogen atoms-containing gas into said vessel, a porous body ranged in the gas-supplying path through which the nitrogen atoms-containing gas can flow, and one of a metal and an alloy positioned in said vessel and spaced from said substrate, said one of a metal and an alloy comprising at least one metallic element selected from the group consisting of Group 2A, Group 3A and Group 4A of the Periodic Table.

14. An apparatus for nitriding a substrate containing at least metallic aluminum according to claim 13, wherein said nitrogen atoms-containing gas is introduced into said vessel through said porous body.

15. An apparatus for nitriding a substrate containing at least metallic aluminum by the steps of heating a substrate containing at least metallic aluminum in vacuum of $10^{-3}$ torrs or less, and heating/nitriding the substrate in an atmosphere containing at least nitrogen continuously during said heating step, said apparatus comprising a vessel for receiving said substrate and enclosing said nitrogen-containing atmosphere during said heating/nitriding step, at least a part of said vessel comprising a porous body through which a nitrogen atoms-containing gas can flow, and means for removing an oxide coating from a surface of said substrate prior to nitriding, said means comprising one of a metal and an alloy positioned in said vessel and spaced from said substrate, said one of a metal and an alloy comprising at least one metallic element selected from the group consisting of Group 2A, Group 3A and Group 4A of the Periodic Table.

16. An apparatus for nitriding a substrate containing at least metallic aluminum according to claim 15, wherein said nitrogen atoms-containing gas is introduced into said vessel through said porous body.

* * * * *

UNITED STATES PATENT AND TRADEMARK OFFICE

CERTIFICATE OF CORRECTION

PATENT NO. : 6,652,803 B2 
DATED : November 25, 2003
INVENTOR(S) : Morimichi Watanabe, Shinji Kawasaki and Takahiro Ishikawa It is certified that error appears in the above-identified patent and that said Letters Patent is hereby corrected as shown below:

Column 3,
Line 44, please change “chat” to -- that --

Column 17,
Line 55, please change “(torn” to -- from --

Signed and Sealed this

Twentieth Day of January, 2004

JON W. DUDAS
*Acting Director of the United States Patent and Trademark Office*